US007592990B2

(12) United States Patent
Miyazawa

(10) Patent No.: US 7,592,990 B2
(45) Date of Patent: Sep. 22, 2009

(54) DISPLAY DEVICE

(75) Inventor: Toshio Miyazawa, Chiba (JP)

(73) Assignee: Hitachi Displays, Ltd., Chiba (JP)

( * ) Notice: Subject to any disclaimer, the term of this patent is extended or adjusted under 35 U.S.C. 154(b) by 0 days.

(21) Appl. No.: 11/447,066

(22) Filed: Jun. 6, 2006

(65) Prior Publication Data

US 2006/0238474 A1 Oct. 26, 2006

Related U.S. Application Data

(63) Continuation of application No. 10/407,243, filed on Apr. 7, 2003, now Pat. No. 7,057,596.

(30) Foreign Application Priority Data

Apr. 10, 2002 (JP) ..... 2002-107969

(51) Int. Cl.
*G09G 3/36* (2006.01)

(52) U.S. Cl. ..... 345/90; 345/88; 345/103

(58) Field of Classification Search ..... 345/76–78, 345/82–84, 87–90, 103, 92, 204, 690; 315/169.1–169.4
See application file for complete search history.

(56) References Cited

U.S. PATENT DOCUMENTS

| | | | | |
|---|---|---|---|---|
| 5,977,944 | A * | 11/1999 | Kubota et al. | 345/89 |
| 6,008,868 | A * | 12/1999 | Silverbrook | 345/88 |
| 2002/0039087 | A1 | 4/2002 | Inukai | |
| 2002/0089471 | A1 | 7/2002 | Murata | |
| 2002/0089496 | A1 | 7/2002 | Numao | |
| 2002/0093472 | A1 | 7/2002 | Numao | |
| 2005/0057478 | A1 | 3/2005 | Miyazawa | |

* cited by examiner

*Primary Examiner*—Regina Liang
(74) *Attorney, Agent, or Firm*—Antonelli, Terry, Stout & Kraus, LLP.

(57) ABSTRACT

A color display of high numerical aperture and multiple gray scales, which can realize multicoloring and area gray scales is accomplished by simplifying the pixel circuit constitution of the display device. A pair of transistors which hold video signals by bridging alternating power supply sources are used as an output circuit to a pixel electrode, and a capacitance is connected to the pixel electrode, whereby the data writing state is controlled by making use of a charge stored in the capacitance.

4 Claims, 8 Drawing Sheets

DISPLAY DEVICE

CROSS REFERENCE TO RELATED APPLICATION

This application is a continuation application of U.S. application Ser. No. 10/407,243, filed Apr. 7, 2003, now U.S. Pat. No. 7,057,596 the contents of which are incorporated herein by reference.

BACKGROUND OF THE INVENTION

The present invention relates to an active matrix type display device, and, more particularly, to a multiple gray scale display device having a pixel memory system, which exhibits high numerical aperture and high definition.

As display devices for notebook type computers or display monitors, which are capable of performing color display with high definition, display devices using various display methods, including a display device which uses a liquid crystal panel, or a display device which uses electroluminescence (particularly organic EL), have been introduced or have been studied for practical use. Liquid crystal display devices are the most popularly used display devices these days. Here, as a typical example of such a display device, a so-called active matrix type liquid crystal display device.

In a thin film transistor (hereinafter referred to as TFT) type liquid crystal display device, which constitutes a typical example of an active matrix type liquid crystal display device, in which a TFT is provided for every pixel to serve as a switching element, a signal voltage (video signal voltage: gray scale voltage) is applied to a pixel electrode, and, hence, there is no crosstalk between pixels, so that a multiple gray scale display of high definition can be realized.

On the other hand, when this type of liquid crystal display device is mounted on an electronic device which uses a battery as a power source, such a portable information terminal or the like, it is necessary to reduce the power consumption incurred by the display. Accordingly, so far, there have been a large number of proposals with respect to ways to provide a memory function to each pixel of the liquid crystal display device.

FIG. 11 is a schematic diagram showing an example of a liquid crystal panel in the form of a low-temperature polysilicon TFT system liquid crystal display device, which incorporates a static R1\N (hereinafter referred to as an SRAM) of I bit in each pixel. The liquid crystal panel is constituted by sandwiching liquid crystal material between a first substrate and a second substrate, which face each other in an opposed manner. In the drawing, reference symbol PNL indicates a liquid crystal panel. The liquid crystal panel PNL includes a pixel portion (display region) AR, which occupies a major portion of the panel area, and a vertical scanning circuit GDR and a horizontal scanning circuit DDR, which are arranged at the periphery of the pixel portion AR on the first substrate. Each pixel of the pixel portion AR includes an image memory (SRAM) of 1 bit. Here, the liquid crystal panel PNL shown in FIG. 11 incorporates a digital-analogue converting circuit (DAC) of about 4 bits in the horizontal scanning circuit DDR thereof, and this digital-analogue converting circuit (DAC) is not an indispensable element.

FIG. 12 is a circuit diagram of the 1 bit SRAM image memory shown in FIG. 11. In the drawing, symbol GL indicates a gate line (scanning line), symbol DL indicates a drain line (signal line), symbol LC indicates liquid crystal, and VCOM indicates a common voltage. Reference symbol PIX indicates a pixel (unit pixel). The pixel PIX has a usual sampling function of supplying a gray scale analogue voltage of 4 bits to 6 bits from the outside to an electrode for driving the liquid crystal as it is, and an image memory function of temporarily storing the external 1 bit data to the SRAM and of outputting alternating voltages ϕp, ϕn corresponding to the 1 bit data to the electrode for the driving liquid crystal.

The selection between the sampling function and the image memory function is controlled from the outside. Here, the alternating voltages ϕp, ϕn are AC signals which are in synchronism with the liquid crystal alternating voltage cycle and alternate with polarities opposite to each other, wherein the alternating voltage ϕn is expressed by an inverted waveform of the alternating voltage ϕp. By adopting such a pixel constitution, it is possible to display 1 bit data stored in the SRAM at a standby time of a mobile telephone, for example, and, hence, the power consumption necessary for writing data can be reduced.

SUMMARY OF THE INVENTION

FIG. 13 is a schematic circuit diagram of one pixel of the liquid crystal display device having the image memory circuit according to a proposal (U.S. application Ser. No. 09/880,819) which has already been made by the applicant of the present application. On a first substrate, a drain line DL1, which constitutes one of a large number of drain lines DL, is provided for supplying video signals to a pixel, while selection signal lines HADL1 and VADL are provided for selecting a pixel to which video signals are to be applied. Reference symbol VCOM indicates a common voltage, which constitutes a fixed voltage and is arranged at a second substrate side in a so-called TN type liquid crystal panel. The pixel has a function of holding the video signal applied thereto until it is selected next time and is rewritten. Here, by replacing liquid crystal LC with electroluminescence elements, an electroluminescence type display device is obtained.

The fixed voltage VCON is applied to a fixed voltage line VCOM-L. The fixed voltage VCOM is supplied to electrodes formed on a second substrate, which sandwiches the liquid crystal LC together with the first substrate. Alternating voltages PBP (corresponding to ϕp in FIG. 12) and PBN (corresponding to ϕn in FIG. 12) are applied to alternating voltage lines PBP-L and PBN-L.

Writing of the video signal to the pixel is performed when two NMOS transistors VADSW1 and HADSW1 assume an ON state in response to respective selection signals applied to the selection signal line HADL1, which constitutes the selection signal line HADL, and the selection signal line VADL.

A first inverter is constituted such that the written video signal potential is used as an input gate (voltage node N8) potential, and electrodes or diffusion regions, which form respective sources or drains of a series connection of a p-type field effect transistor PLTF1 and an n-type field effect transistor NLTF1, are electrically connected, thus forming an outputting portion (voltage node N9). A voltage node is simply referred to as a "node" hereinafter.

A second inverter is constituted of a series connection of a p-type field effect transistor PLTR1 and an n-type field effect transistor NLTR1, which use the potential of the output portion (node N9) to which the electrodes or diffusion regions which form respective sources or drains of the p-type field effect transistor PLTF1 and the n-type field effect transistor NLTF1, which constitute the first inverter, are electrically connected as an input gate potential.

A third inverter is constituted of a series connection of p-type field effect transistor PPVS1 and an n-type field effect transistor NPVS1, which uses the potential of the output portion (node N8) to which the electrodes or diffusion regions which form respective sources or drains of the p-type field effect transistor PLTR1 and the n-type field effect transistor NLTR1, which constitute the second inverter, are electrically connected as an input gate potential.

Then, the output portion of the p-type field effect transistor PLTR1 and the n-type field effect transistor NLTR1, which constitute the second inverter, is simultaneously electrically connected to the input gate (node N8) of the first inverter. In the n-type field effect transistors NLTF1 and NLTR1, which constitute the first and second inverters, the sources, the drains or the diffusion regions (node N6), which do not form the output of the inverters, are connected to one (PBN) of the above-mentioned pair of alternating voltage lines.

Further, in the p-type field effect transistors PLTF1 and PLTR1, which constitute the first and second inverters, the sources, the drains or the diffusion regions (node N4), which do not form the output of the inverters, are connected to the alternating voltage line PBP, which makes a pair with an alternating voltage line (node N6) to which the electrode forming the source, the drain or the diffusion regions of the n-type field effect transistors of the first and second inverters, which do not form the outputs of the inverters, are connected.

In the p-type field effect transistor PPVS1 and the n-type field effect transistor NPVS1, which constitute the third inverter, one of the electrodes (nodes N6 and N10), which constitute the respective sources or the drains or the diffusion regions (node N6) and which do not form the output portion (node N10) of the inverters, is connected to either one of the alternating voltage lines (PBN) and the other is connected to the fixed voltage line VCOM.

The number of colors which can be realized by a 1 bit SRAM is 2 for the respective colors R, G, B, and, hence, the total number is 8 colors (2×2×2). However, the number of colors is too small for a color display, and, hence, the use of the above-mentioned proposal is limited to a method for reducing power consumption for writing data by displaying 1 bit data that is stored in the SRAM at the above-mentioned standby time of a mobile telephone.

FIG. 14 is a diagram showing an example of area gray scale pixels which are formed by combining the unit pixels which have been described in conjunction with FIG. 13. In this example, those areas of the pixel electrodes which constitute respective unit pixels are provided as a combination of three types of cells consisting of a cell CL-A, a cell CL-B and a cell CL-C, which differ in area from each other. By selectively combining these cells, which differ in area, a 3 bit, 8 gray scale display is realized. By constituting the respective colors (R, G, B) using this combination, one color pixel which enables a multicolor display can be realized.

However, in the pixel memory method described in conjunction with FIG. 13, the number of wiring and the number of transistors are large and the circuit scale is enlarged; and, hence, the reduction of the power consumption is limited, and, at the same time, the enhancement of the numerical aperture is difficult. Further, in the method described in conjunction with FIG. 14, the circuit constitution and the constitution of the pixel electrode become complicated, and, hence, it is difficult to reduce the manufacturing cost.

Accordingly, it is an object of the present invention to provide a display device which enables a color display of high numerical aperture and multiple gray scales by simplifying the circuit constitution and multicoloring and by realizing area gray scales due to a simplification of the pixel electrodes.

To achieve the above-mentioned object, in accordance with the present invention, the display device is configured such that a pair of CMOS transistors, which hold video signals, are also used as an output circuit to the pixel electrodes, and a pixel electrode is connected to a capacitance, and a state in which data is written in a SRAM is controlled using a charge stored in the capacitance. Typical constitutions of the present invention are as follows.

(1) In a display device, pixels are provided corresponding to portions where a plurality of scanning signal lines and a plurality of signal lines cross each other; the pixels are constituted of a pixel electrode, a switching element for selecting the pixel electrode, and a storage circuit which is formed between the pixel electrode and the switching element and which stores data to be written in the pixel electrode; the storage circuit includes a pair of alternating voltage power source lines that are capable of applying alternating voltages with, polarities that are opposite to each other; the storage circuit has a first pair of transistors consisting of an NMOS transistor and a PMOS transistor, which are connected in series between the pair of alternating voltage power source lines, and a second pair of transistors consisting of an NMOS transistor and a PMOS transistor, which are connected in series between the pair of alternating power source lines and in parallel with respect to the first pair of transistors; a common connection point of control electrodes of the first pair of transistors is connected to a series connection intermediate point of the second pair of transistors, and a common connection point of control electrodes of the second pair of transistors is connected to a series connection intermediate point of the first pair of transistors; an output point of the switching element is connected to a connection point of the first pair of transistors; the series connection intermediate point of the second pair of transistors is connected to the pixel electrode; and a capacitance is connected between the common connection point of the control electrodes of the second pair of transistors and the series connection intermediate point.

(2) In the constitution (1), resistance elements are provided between the first pair of transistors and the pair of alternating voltage power source lines respectively.

(3) In the constitution (1) or (2), the pixel is constituted of a unit pixel of one color and one color pixel is constituted of plural unit pixels.

(4) In the constitution (3), a pixel electrode of each unit pixel which constitutes one color pixel is formed of a plurality of electrodes which differ in area.

(5) In the constitution (4), the plurality of electrodes correspond to a gray scale display of 2 bits or more and are selected by the switching element.

Due to the above-mentioned respective constitutions, the number of wiring and the number of transistors can be reduced and, at the same time, lowering of the numerical aperture can be prevented, whereby it is possible to obtain an image display of multiple gray scales and high definition.

The present invention is not limited to the above-mentioned constitutions and the constitutions of embodiments described hereinafter, and various modifications can be made without departing from the technical concept of the present invention.

DESCRIPTION OF THE PREFERRED EMBODIMENTS

Figure 1:
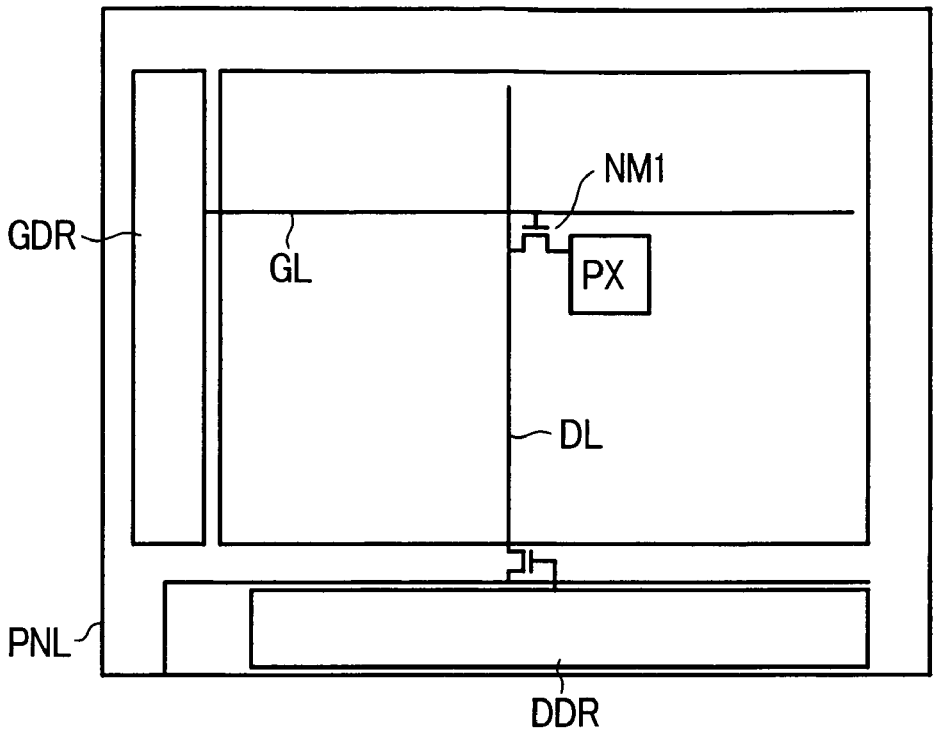
FIG. 1 is a schematic diagram of one embodiment of the circuit constitution of the liquid crystal panel, which constitutes a liquid crystal display device of the present invention.

Preferred embodiments of a display device according to the present invention will be explained in detail hereinafter in conjunction with the drawings, which describe respective embodiments of the invention. FIG. 1 is a schematic diagram showing one embodiment of the circuit constitution of one pixel of a liquid crystal panel which constitutes a liquid crystal display device of the present invention. In the drawing, reference symbol PNL indicates a TFT panel, wherein, on a first substrate thereof, a vertical scanning circuit GDR and a horizontal scanning circuit DDR are arranged at the periphery of a pixel portion (display region) AR, which occupies a major portion of the area of the panel. Common electrodes are arranged on a second substrate.

In FIG. 1, with respect to drain lines DL, which constitute video signal lines, and gate lines GL, which constitute scanning lines, only one drain line DL and only one gate line GL are indicated for the sake of brevity of the explanation. In an actual liquid crystal display device, 8 lines (256 colors), 12 lines (4096 colors) or the like of the drain lines DL are provided, corresponding to the number of pixels, and these drain lines DL are sequentially connected to the gate lines GL, which extend from the vertical scanning circuit GDR. Video signals (data signals), which are supplied from the drain lines DL, are written in the pixels PX in response to the selection of the gate lines GL that extend from the horizontal scanning circuit DDR. Here, the pixel PX represents a unit pixel. When a color display of three colors, consisting of R, G and B, is produced, one color pixel is constituted of three unit pixels.

Figure 2:
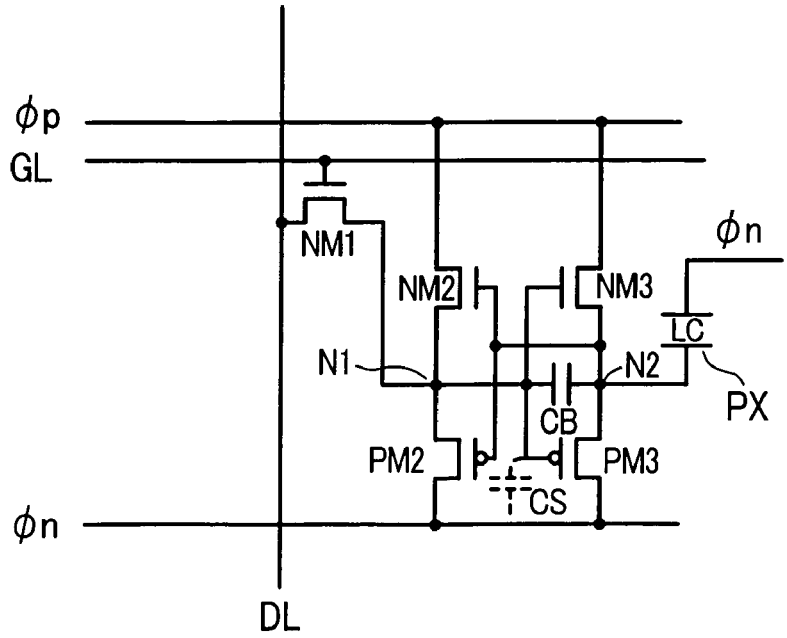
FIG. 2 is a schematic circuit diagram of an image memory for one bit, as used in the display device of FIG. 1.
Figure 13:
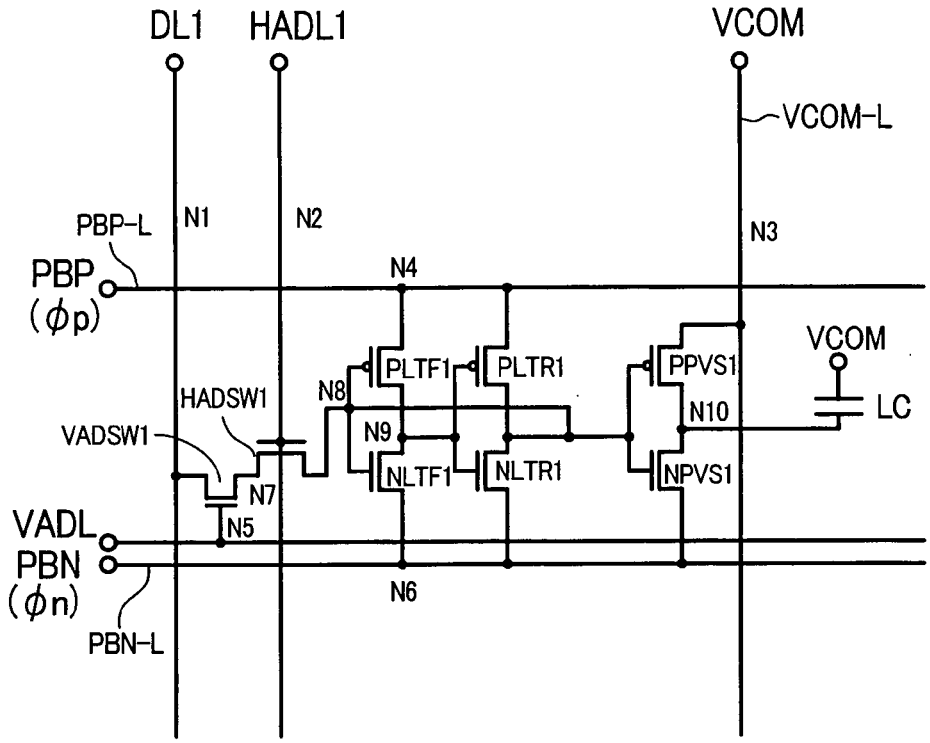
FIG. 13 is a schematic circuit diagram of one pixel of a liquid crystal display device having an image memory circuit according to a proposal which has already been made by the applicant of the present application.
Figure 14:
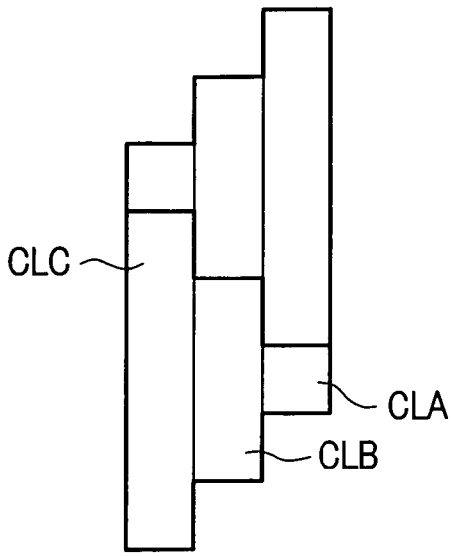
FIG. 14 is a diagram showing an example of an area gray scale pixel which is formed by combining unit pixels of the type shown in FIG. 13.

FIG. 2 is a circuit diagram of an image memory for one bit, as used in the display device of FIG. 1. Although the basic operation is substantially the same as the operation described in conjunction with FIG. 13, this embodiment differs from the example shown in FIG. 13 with respect to the fact that the pair of CMOS transistors for holding data also function as an output circuit to the pixel electrode PX. The image memory (storage circuit) has a first pair of transistors, consisting of an NMOS transistor NM2 and a PMOS transistor PM2, which are connected in series across a pair of power source lines ϕp, ϕn, and a second pair of transistors, consisting of an NMOS transistor NM3 and a PMOS transistor PM3, which are connected in series across the pair of power source lines ϕp, ϕn, in parallel with respect to the first pair of transistors.

Alternating voltages with polarities opposite to each other are supplied to the pair of power source lines ϕp, ϕn. The common connection point of the control electrodes of the NMOS transistor NM2 and the PMOS transistor PM2, which constitute the first pair of transistors of the memory circuit, is connected to a series connection intermediate point (node) N2 of the NMOS transistor NM3 and PMOS transistor PM3, which constitute the second pair of transistors. Further, the common connection point of the control electrodes of the NMOS transistor NM3 and the PMOS transistor PM3, which constitute the second pair of transistors, is connected to a series connection intermediate point (node) N1 of the NMOS transistor NM2 and PMOS transistor PM2, which constitute the first pair of transistors.

Reference symbol NM1 indicates a switching element (transistor). This switching element NM1 is selected by the gate line GL and supplies video signals (data) which appear on the drain line DL to the node N1 of the NMOS transistor NM2 and the PMOS transistor PM2, which constitute the first pair of transistors. An output point of the switching element NM1 is the node N1 of the NMOS transistor NM2 and the PMOS transistor PM2, which constitute the first pair of transistors, while the node N2 of the NMOS transistor NM3 and the PMOS transistor PM3, which constitute the second pair of transistors, is connected to the pixel electrode of the unit pixel PX. Then, a bootstrap capacitance CS is inserted between the node N2 of the NMOS transistor NM3 and the PMOS transistor PM3, which constitute the second pair of transistors, and the common connection point of the control electrodes thereof. Here, reference symbol CS indicates a floating capacitance.

Figure 3:
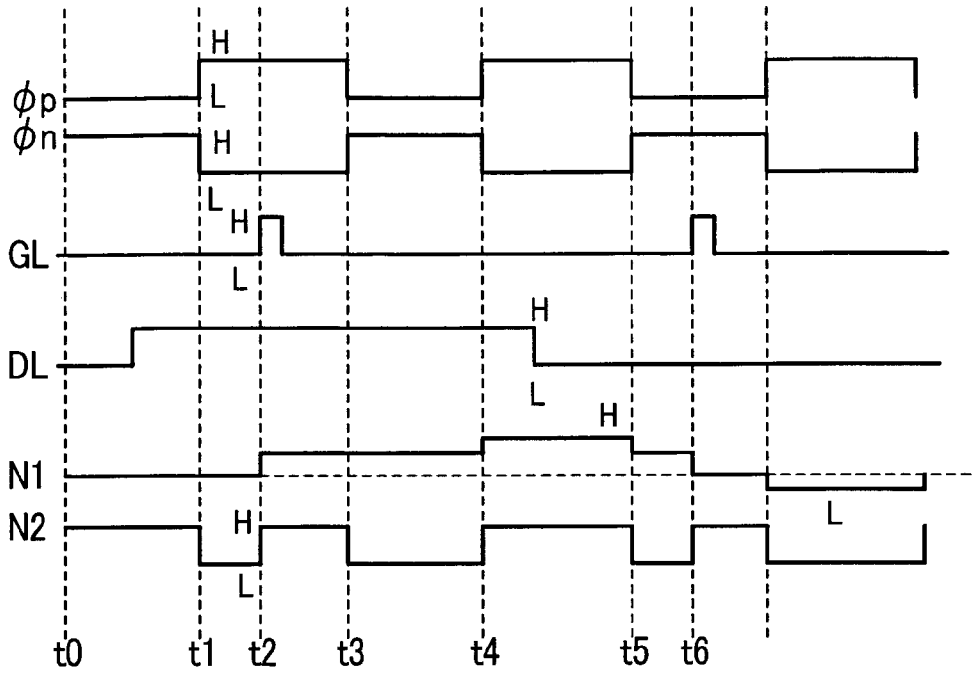
FIG. 3 is an operational waveform chart showing signals or voltages applied to respective lines in FIG. 2.

FIG. 3 is an operational waveform chart showing signals or voltages applied to the respective lines shown in FIG. 2. In the drawing, ϕp, ϕn, GL, DL, N1, N2 respectively correspond to the signals or voltages applied to points which are indicated by the same reference symbols in FIG. 2. As seen in FIG. 3, ϕp, ϕn are alternating voltages for driving the liquid crystal, and they have phases that are opposite to each other, wherein the alternating voltages ϕp, ϕn repeat High H and Low L levels in a so-called single frame period.

Assume a case in which the state of the image memory at a point of time to in FIG. 3, that is, in which the node N1 is low. In the circuit shown in FIG. 2, since the node N1 is Low, the transistor PM3, which is a p-type TFT, assumes the ON state, and, hence, the node N2 is connected to the alternating voltage ϕn. Accordingly, the potential state of the node N2 at the point of time to is high. Since the node N2 is high, transistor NM2, which is an n-type TFT, also assumes the ON state, and, hence, node N1 is connected to the alternating voltage ϕp and the node N1 assumes the Low state, which is the rewritable state.

At a point of time t1, the pair of alternating voltages ϕp, ϕn reverse their potential states. When it is designed that the potential change of the node N2 is generated earlier than the potential change of the node N1, since the node N2 is connected to the alternating voltage ϕn through the transistor PM3, the potential of the node N2 follows the change of potential of the alternating voltage ϕn and is changed from the High state to the Low state. This change of the potential of the node N2 from the High state to the Low state is transmitted to the node N1 through the bootstrap capacitance CB, so that the voltage of the node N1 is lowered momentarily (that is, until the node N1 is rewritten) by $\Delta V=(V_{High}-V_{Low})\times(CB/(CB+CS))$. Here, CS indicates a capacitance of the node N1, other than the bootstrap capacitance CB.

By designing this M such that ΔV assumes a value larger than a threshold value voltage $V_{th}$(PM3) of the transistor PM3 (absolute value of ΔV≧absolute value of $V_{th}$(PM3)), it is possible to make the node N2 assume a potential equal to the Low potential of the alternating voltage ϕn, while ignoring an effect of the threshold value voltage of the transistor PM3. Along with the change of the node N2 to the Low state, the transistor PM3 assumes the OFF state and the transistor PM2 assumes the ON state. Accordingly, the node N1 is connected to the alternating voltage ϕn through the transistor PM2 and the node N1 assumes the Low state, that is, the rewritable state.

When the gate line GL assumes the High state and the transistor NM1 assumes the ON state at a point of time t2, the data of the High state of the drain line DL is written in the node N1. When the design is such that the potential change of the node N2 is generated earlier than the potential change of the node N1, that is, when the design is such that the connection between the alternating voltages ϕp, ϕn and the node N1 is weak (high resistance connection), it is possible to control the state of the node N1 at the state of the drain line DL, during the time the gate line GL is in the High state, so that the node N1 assumes the High state.

Due to such a constitution, the transistor PM3 is changed from the ON state to the OFF state and the transistor NM3 is changed from the OFF state to the ON state, while the node N2 is connected to the alternating voltage ϕp and is changed to the High state of the alternating voltage ϕp. Corresponding to such a change, the transistor PM2 assumes the OFF state and the transistor NM2 assumes the ON state, and, hence, the node N1 is connected to the alternating voltage ϕp through the transistor NM2. This provides a state in which the High state of the input is held.

At a point of time t3, the pair of alternating voltages ϕp, ϕn again reverse their potential states. Since the node N2 is connected to the alternating voltage ϕp through the transistor NM3, the potential of the node N2 follows the change of potential of the alternating voltage ϕp and is changed from the High state to the Low state. This change of the potential of the node N2 from the High state to the Low state is transmitted to the node N1 through the bootstrap capacitance CB, and the voltage of the node N1 is lowered momentarily (until the node N1 is rewritten) by $\Delta V=(V_{High}-V_{Low})\times(CB/(CB+CS))$. Here, CS indicates the capacitance of the node N1 other than the bootstrap capacitance CB.

Since the transistor NM3 is in the discharge mode, when the relationship High (ϕp)−ΔV≧$V_{th}$ (NM3) is satisfied, it is possible to lower the node N2 to the Low state of the alternating voltage ϕp. Along with the change of the node N2 to the Low state, the transistor NM2 assumes the OFF state and the transistor PM2 assumes the ON state. The node N1 is connected to the alternating voltage ϕn through the transistor PM2. This implies that the node N1 assumes the rewritable state, in which the input assumes the High state and the memory state is held.

At a point of time t4, the pair of alternating voltages (power sources) ϕp, ϕn again reverse their potential states. Since the node N2 is connected to the alternating voltage ϕp through the transistor NM3, the potential of the node N2 follows the change of potential of the alternating voltage ϕp and is changed from the Low state to the High state. This change of the potential of the node N2 from the Low state to the High state is transmitted to the node N1 through the bootstrap capacitance CB, and the voltage of the node N1 is raised momentarily (until the node N1 is rewritten) by $\Delta V=(V_{High}-V_{Low})\times(CB/(CB+CS))$. Here, CS indicates the capacitance of the node N1, other than the bootstrap capacitance CB.

By designing ΔV such that ΔV assumes a value larger than a threshold value voltage $V_{th}$(PM3) of the transistor PM3 (absolute value of ΔV≧absolute value of $V_{th}$(PM3)), it is possible to make the node N2 assume a potential equal to the High potential of the alternating voltage ϕp, while ignoring an effect of the threshold value voltage of the transistor PM3. Along with the change of the node N2 to the High state, the transistor PM2 assumes the OFF state and the transistor PM2 assumes the ON state. Due to such a constitution, the node N1 makes the transistor PM2 assume the OFF state and the transistor NM2 assume the ON state. Accordingly, the node N1 is connected to the alternating voltage ϕp through the transistor NM2, and the node N1 assumes the High state, that is, the rewritable state.

At a point of time t5, an operation equal to the operation which is performed at the point of time t3 is performed. At a point of time t6, the voltage applied from the gate line assumes the High state, and the transistor NM1 assumes the ON state, so that Low state of the drain line at this point of time is written in the node N1. In the same manner as the above-mentioned operation at the point of time t3, in this case, the node N1 assumes the Low state, and the transistor PM3 assumes the ON state, so that the node N2 is connected to the alternating voltage ϕn. Since the alternating voltage ϕn is in the High state at this point of time, the transistor NM3 assumes the ON state, and the memory holding setting is changed to a Low holding setting. Thereafter, the operations at the above-mentioned points of time t0 to t6 and the combination of these operations are repeated.

From the above-mentioned operation, it should be understood that the node N1 repeats a connection and disconnection with the alternating power source lines so as to hold the input state, while the node N2 is connected to either the alternating voltage ϕp or ϕn in accordance with the condition of the node N1. Here, it should be understood that when the node N2 is connected to one of the liquid crystal driving electrodes (pixel electrode) and another driving voltage (common electrode) is connected to the alternating voltage ϕn, an operation is performed, such that the alternating voltage of the High state and Low state can be applied to the liquid crystal LC when the node N1 is in the High state, and the voltage applied to the liquid crystal LC is set to 0 when the node N1 is in the Low state.

As has been explained in conjunction with the above-mentioned operation at the point of time t1, it is a crucial requirement for the circuit constitution of this embodiment that the circuit is designed such that a potential change of the node N2 takes place earlier than the potential change of the node N1. Although many techniques are conceivable to realize such a design requirement, one example will be explained hereinafter.

Figure 4:
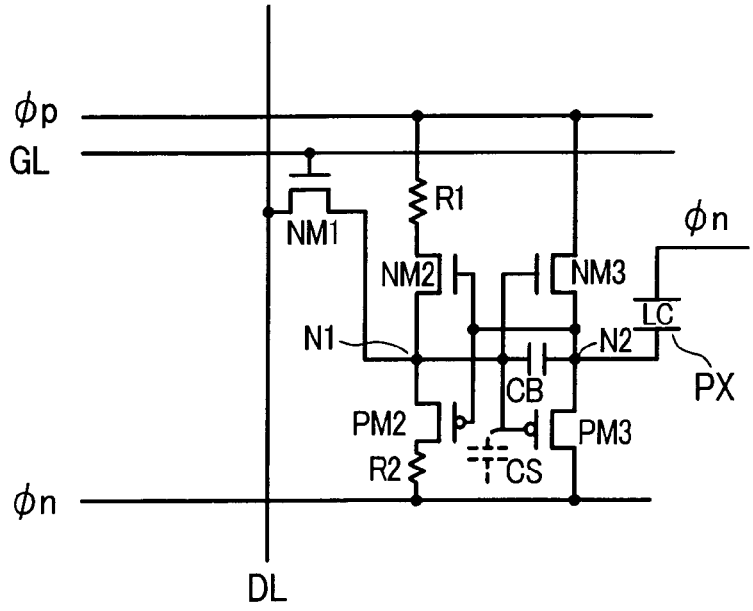
FIG. 4 is a schematic circuit diagram showing a constitutional example in which the change of potential of the node N2 is generated earlier than the change of potential of the node N1 in the image memory circuit shown in FIG. 2.

FIG. 4 is a circuit diagram showing an example of how to make the potential change of the node N2 take place earlier than the potential change of the node N1 in the circuit of the image memory shown in FIG. 2. In this circuit, a resistance R1 is inserted between the transistor NM2, which constitutes one of the first pair of transistors, and the alternating power source line of the alternating voltage ϕp, and a resistance R2 inserted between the transistor PM2, which constitutes another of the first pair of transistors, and the alternating power source line of the alternating voltage ϕn.

The transistors NM2, PM2 which constitute feedback circuit elements to the node N1 are provided for compensating the fluctuation of data potential of the node N1 attributed to leakage or the like, and, hence, the connection between these transistors NM2, PM2 and the alternating power source lines of the alternating voltage ϕp, ϕn may be set to a state having a large time constant, that is, there is a high resistance connection. Accordingly, to realize the above-mentioned requirement, as shown in FIG. 4, the resistances R1, R2 may be simply connected in series with the first pair of transistors. These resistances can be easily formed by controlling an opening pattern of an exposure mask used in the manufacture of this circuit (pattern for forming connection patterns of the alternating power source lines ϕp, ϕn and the transistors NM2, PM2). Further, it is possible to modify the above-described constitution by increasing the ON resistance of the transistors NM2, PM2 in place of using discrete resistances. Diodes also may be used in place of the resistances.

Figure 5:
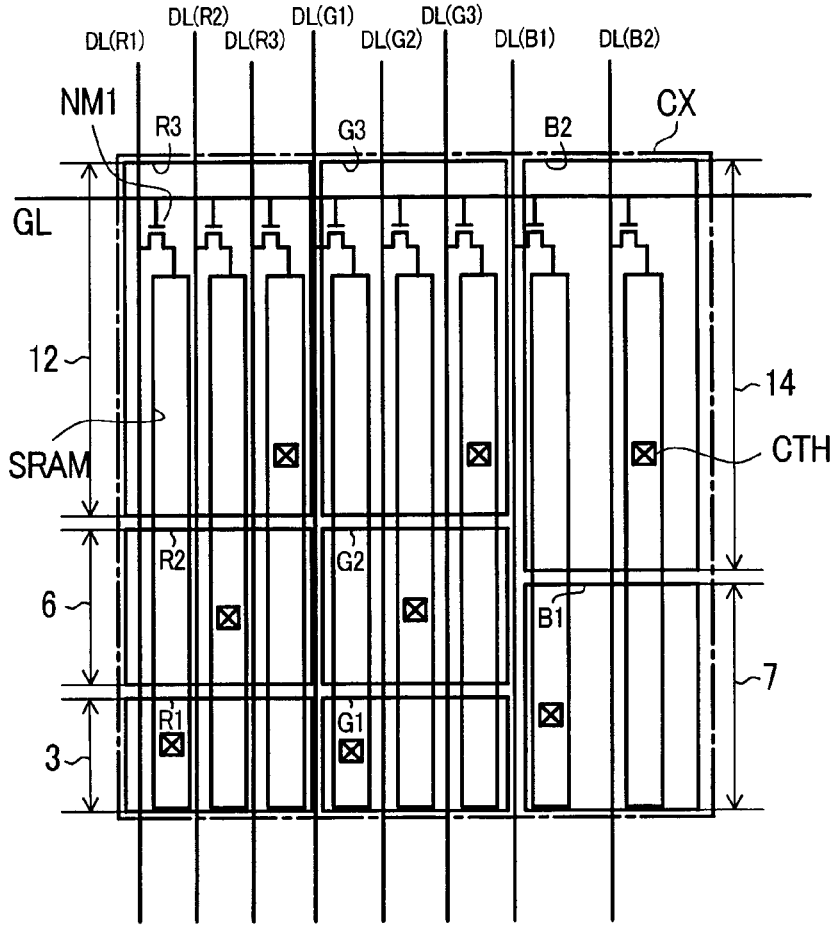
FIG. 5 is a plan view showing one example of the layout in a display region of one color pixel, when the gray scale of the color display adopts a 256 color display, wherein R is 3 bit data, G is 3 bit data and B is 2 bit data.

An example of the layout of a multicolor pixel using the unit pixels of the present invention will be explained. FIG. 5 is a plan view showing one example of the layout in a display region of one color pixel, when the gray scale of a color display adopts a display of 256 colors, where R is 3 bit data, G is 3 bit data and B is 2 bit data. In the drawing, reference symbol CX indicates one pixel color and R1, R2, R3 and G1, G2, G3 indicate divided unit pixel electrodes of red(R) and green(G), which are controlled by area gray scales corresponding to respective three bit data, and B1, B2 indicate divided unit pixel electrodes of blue(B) which are controlled by area gray scales corresponding to respective 2 bit data. The unit pixel R is constituted of the divided unit pixel electrodes E1, R2 and R3, the unit pixel G is constituted of the divided unit pixel electrodes G1, G2 and G3, and the unit pixel B is constituted of the divided unit pixel electrodes B1 and B2. The divided unit pixel electrodes are the above-mentioned liquid crystal driving electrodes.

The respective unit pixels R and G are selected by the switching elements NM1, which are respectively connected to the gate line GL, three drain lines DL(R1), (R2), (R3) and three drain lines DL(G1), (G2), (G3), which supply 3 bit data. Each unit pixel includes image memories (SRAM) in a number which corresponds to the bit number controlled by respective switching elements NM1, and outputs of the image memories SRAM are, as shown in FIG. 5, electrically connected to the divided unit pixel electrodes through contact holes CTH.

Respective unit pixels R, G and B have the same size in the extension direction of the gate line GL, and each of the unit pixels R, C is divided into divided unit pixels at a rate of "3", "6" and "12" in the extension direction of the drain line DL, while the unit pixel B is divided into divided unit pixels at a rate of "7" and "14". Due to this division, area gray scales of 256 colors are realized.

With provision of the color pixel having the layout shown in FIG. 5, a color display of 256 colors can be realized using the 8 bit data in total consisting of R: 3 bit data, G: 3 bit data and B: 2 bit data, while display data which has no change is displayed using data stored in the memory, so that data transfer for every frame is unnecessary, whereby the power consumption can be reduced.

Figure 6:
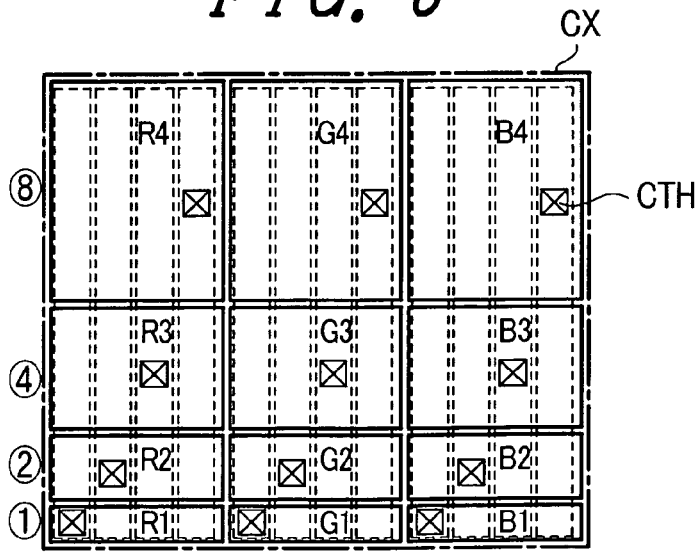
FIG. 6 is a plan view showing one example of the layout in a display region of one color pixel, when the gray scale of the color display adopts a 4096 color display, wherein R, G and B are, respectively, 8 bit data.

FIG. 6 is a plan view showing one example of a layout in a display region of one color pixel when the gray scale of a color display adopts a display of 4096 colors, where R is 8 bit data, G is B bit data and B is 8 bit data. In the drawing, the same reference symbols as used in the above-mentioned respective drawings correspond to parts having identical functions. In FIG. 6, the image memory SRAM, the switching elements, the drain line, the gate line and the like are omitted.

Respective divided unit pixels R1 to R4, G1 to G4 and B1 to B4 are controlled, as indicated by (1), (2), (4), (8) in the drawing, by the switching elements which are turned on or off corresponding to the respective bit data. A color display of 4096 colors can be realized using this layout, while display data which has no change is displayed using data stored in the memory, so that data transfer for every frame is unnecessary, whereby the power consumption can be reduced.

As described above, by making the pixels per se have a data holding function (data memory function), it is unnecessary to feed data to pixels for every frame, and it is sufficient to rewrite only changed portions of data. Further, by providing a memory function to each pixel, it is possible to produce a display by reading the pixels of the display region in a random manner. A random access display can be performed by providing a random access circuit, as will be described hereinafter.

Figure 7:
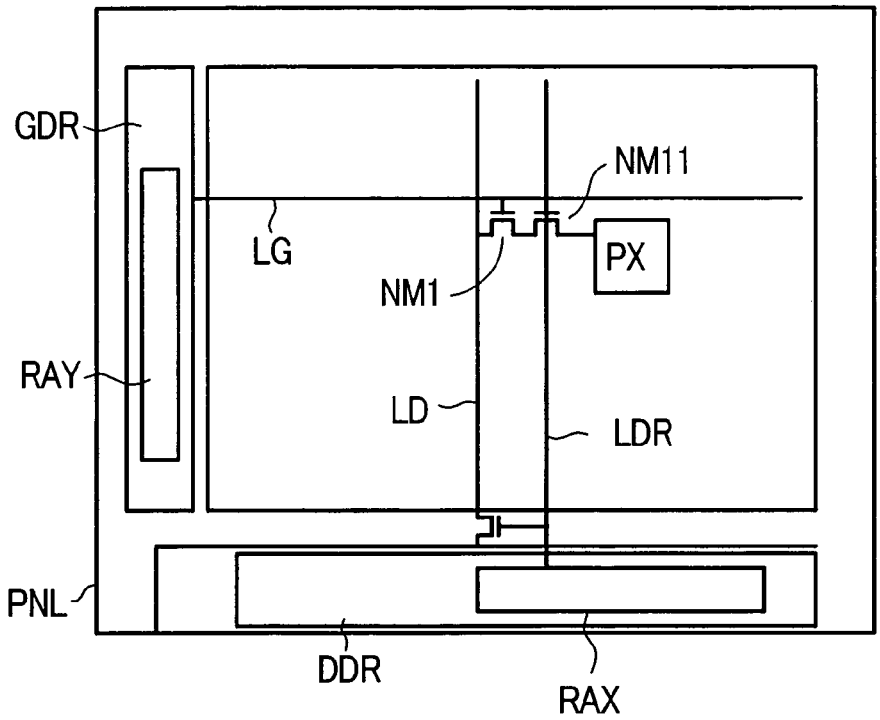
FIG. 7 is a schematic diagram showing another embodiment of the circuit constitution of a liquid crystal panel of a liquid crystal display device of the present invention.
Figure 8:
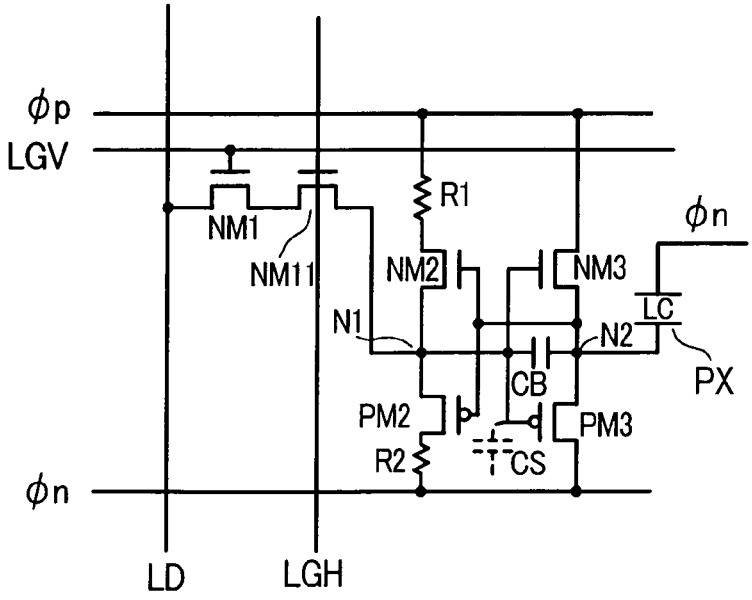
FIG. 8 is a schematic circuit diagram of an image memory for one bit, as used in the display device of FIG. 7.

FIG. 7 is a schematic view showing another embodiment of the circuit constitution of the liquid crystal panel which constitutes the liquid crystal display device of the present invention. Further, FIG. 8 is a circuit diagram of an image memory for 1 bit as used in the display device of FIG. 7. In FIG. 7 and FIG. 8, the same reference symbols as those used in FIG. 1 and FIG. 2 correspond to parts having identical functions, while RAX indicates a horizontal random access circuit, RAY indicates a vertical random access circuit, and NM11 indicates a horizontal selection transistor. This embodiment is characterized by the fact that the horizontal random access circuit RAX and the vertical random access circuit RAY are added to the horizontal scanning circuit DDR and the vertical scanning circuit GDR shown in FIG. 1, respectively, and further by the fact that the horizontal selection transistor NM11 is added to the output point of the switching element NM1.

Due to such a constitution, it is possible to realize both a display mode based on the usual sequential scanning, as explained in conjunction with FIG. 1, and a display mode based on random access. Further, although the horizontal random access circuit RAX and the vertical random access circuit RAY are respectively added to the horizontal scanning circuit DDE and the vertical scanning circuit GDR in this embodiment, it is needless to say that it is possible to use only the horizontal random access circuit RAX and the vertical random access circuit RAY in place of the horizontal scanning circuit DDR and the vertical scanning circuit GDR.

Figure 9:
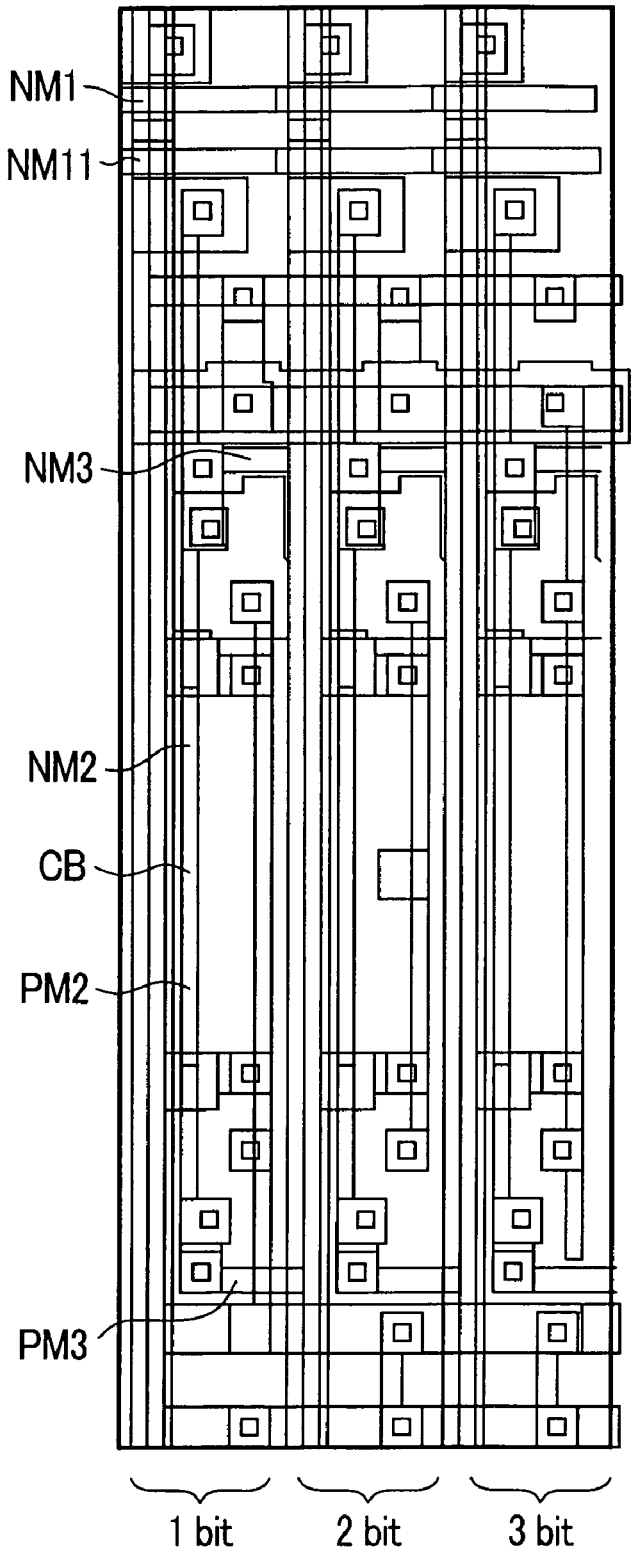
FIG. 9 is a plan view showing an example of a specific arrangement of the pixel memory on a display panel according to the present invention.

FIG. 9 is a plan view showing an example of a specific arrangement on the display panel of the pixel memory according to the present invention. That is, this arrangement includes the horizontal selection transistor NM11, which enables the random access display mode which was described in conjunction with FIG. 7 and FIG. 8 and is formed by taking the 3 bit memory that was described in conjunction with FIG. 5. The same reference symbols in the drawing as those reference symbols used in the drawings of the previous embodiments indicate parts having identical functions. The lateral direction in FIG. 9 coincides with the direction of extension of the gate line and the vertical direction in FIG. 9 coincides with the direction of extension of the drain line. FIG. 9 shows the arrangement of respective transistors NM1, NM11, NM2, NM3, PM2, PM3 and the bootstrap capacitance CB formed on the display panel.

Figure 10:
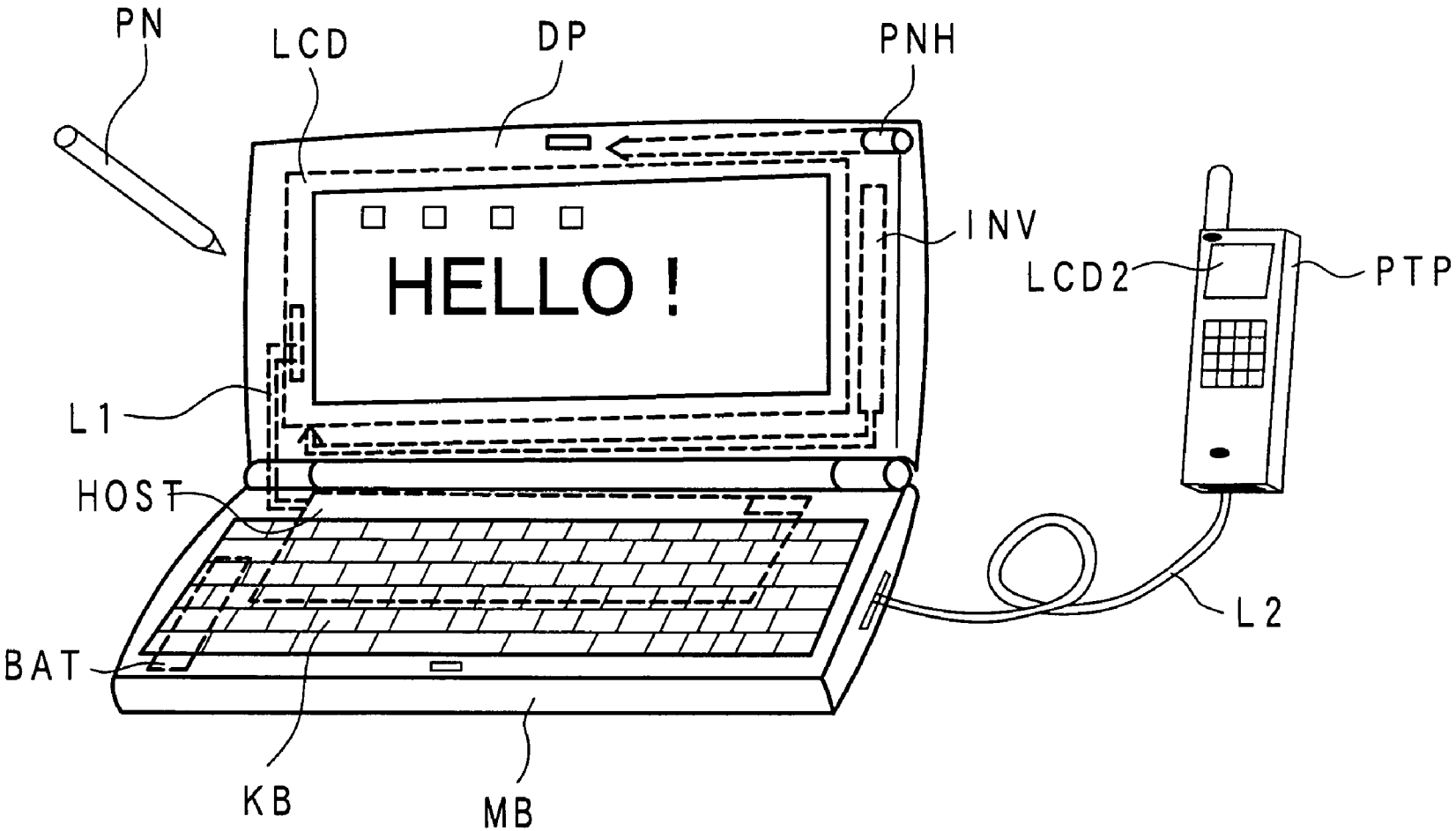
FIG. 10 is a perspective view showing an example of a portable information terminal as an example of electronic equipment on which the display device according to the present invention is mounted.
Figure 11:
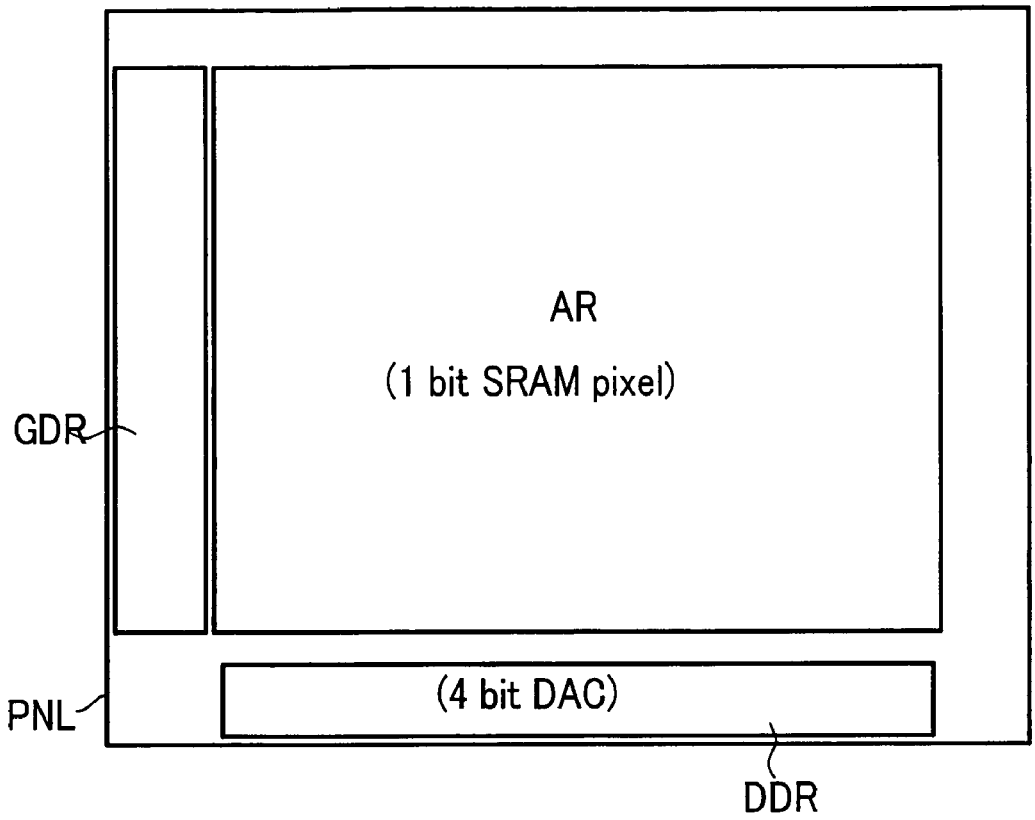
FIG. 11 is a schematic diagram showing an example of a liquid crystal panel in the form of a law-temperature polysilicon TFT type liquid crystal display device, which incorporates a static LAM of one bit in each pixel.
Figure 12:
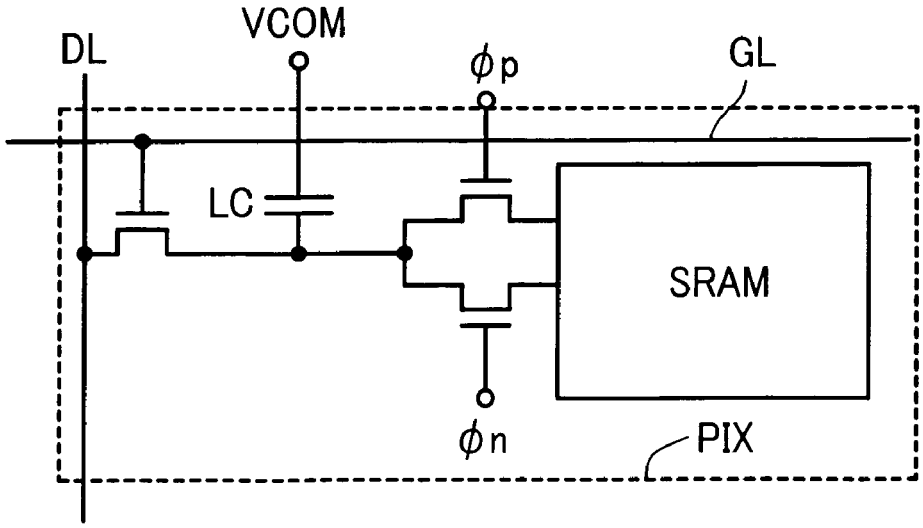
FIG. 12 is a circuit diagram of a one bit SRAM image memory, as used in the display device of FIG. 11.

FIG. 10 is a perspective view showing a portable information terminal as an example of electronic equipment on which the display device of the present invention is mounted. This portable information terminal (PDA) houses a host computer HOST and a battery BAT, and it is constituted of a body part MB, which is provided with a keyboard KB on a surface thereof, and a display part DP, which uses a liquid crystal display device LCD as the display device, and mounts an inverter INV for a backlight therein. The portable information terminal is configured such that a mobile telephone PTP can be connected to the body part MB by way of a connection cable L2, thus enabling communication with a remote place.

The liquid crystal display device LCD of the display part DP is connected with the host computer HOST by way of an interface cable L1. Since the liquid crystal display device LCD has a image storage function with respect to data which the host computer HOST transmits to the display device LCD, it is sufficient to transmit only that portion of the data which differs from the data used in the previous display frame, and it is unnecessary to transmit data when there is no change in the display, whereby the burden imposed on the host computer HOST can be extremely lightened. Accordingly, an image processing device using the display device of the present invention can exhibit low power consumption, can be readily miniaturized, and can realize high-speed processing and multi-functioning.

Here, a pen holder PNH is mounted on a portion of the display part DP of the portable information terminal, and an input pen PN is housed in the pen holder PNH. Accordingly, by inputting various information using the key board KB, or by applying a pushing manipulation to a surface of a touch panel, or by tracing the surface of the touch panel, or by writing letters to the surface of the touch panel with the input pen PN, the liquid crystal display device can perform inputting of various information, selection of information displayed on a liquid crystal display element PNL, selection of processing function and other various manipulations.

Here, the shape and the structure of the portable information terminal (PDA) of this type are not limited to those shown in the drawings, and portable information terminals which have various shapes, structures and functions are conceivable. Further, by adopting the display device of the present invention as a display device LCD2 used in a display part of a portable telephone PTP, as shown in FIG. 10, the quantity of information in the form of display data transmitted to the display element LCD2 can be reduced, and, hence, the quantity of image data which is transmitted through radio waves or communication lines can be reduced, making it possible to perform display of characters, devices and photos with high gray scales and high definition on a display portion of the mobile telephone. Further, it is also possible to perform animated image display.

Further, it is needless to say that the display device of the present invention is applicable not only in a portable information terminal and a portable telephone explained in conjunction with FIG. 10, but it is also applicable to a desktop type personal computer, a notebook type personal computer, a projection type liquid crystal display device and monitoring equipment of other types of information terminal.

Further, the display device of the present invention is not limited to a liquid crystal display device, it being also applicable to any type of matrix type display device, such as an organic EL display device, plasma display device or the like.

As has been described heretofore, according to the present invention, simplification of the circuit constitution and multicoloring can be easily performed, and, further, area gray scale can be realized by simplifying the pixel electrode, whereby it is possible to provide a display device which can produce a color display of multiple gray scales by exhibiting a high numerical aperture and using the least amount of wiring.

The invention claimed is:

1. A display device comprising:

a plurality of scanning lines;

a plurality of signal lines which are arranged to cross said plurality of scanning lines;

a plurality of color pixels;

a plurality of storage circuits for storing data; and a pair of alternatig voltage power source lines connected to the storage circuit for applying alternative voltages varying in polarities opposite to each other, wherein:

each of the color pixels has a plurality of unit pixels, each of the unit pixels is divided into a plurality of divided unit pixels, each of the divided unit pixels has a divided unit pixel electrode, the divided unit pixel electrode is connected to each of the storage circuits, each of the signal lines is connected to the storage circuits via a switching element for selecting the divided unit pixel electrode, each of the storage circuits is formed between the divided unit pixel electrode and the switching element, and each of the storage circuits has a first pair of transistors including an NMOS transistor and a PMOS transistor connected in series across the air of alternating voltage power source lines, and a second pair of transistors, including an NMOS transistor and a PMOS transistor, which connected in series across the pair of alternating voltage power source lines and in parallel with respect to the first pair of transistors, wherein a common connection point of control electrodes of the first pair of transistors is connected to a series connection intermediate point of the second pair of transistors, and a common connection point of control electrodes of the second pair of transistors is connected to a series connection intermediate point of the first pair of transistors, wherein an output point of the switching element is connected to a connection point of the first pair of transistors, wherein the series connection intermediate point of the second pair of transistors is connected to the divided unit pixel electrode, and wherein a capacitor is connected between the common connection point of the control electrodes of the second pair of transistors and the series connection intermediate point, and wherein the number of the divided unit pixels of at least one of the unit pixels is different from the number of the divided unit pixels of other unit pixels.

2. A display device according to claim 1, wherein:

the plurality of unit pixels are a unit pixel of Red, a unit pixel of Green and a unit pixel of Blue, and the number of the divided unit pixels of the unit pixel of Blue is smaller than both that of the unit pixel of Red and that of the unit pixel of Green.

3. A display device according to claim 2, wherein:

the unit pixel of Red and the unit pixel of Green are divided into three divided unit pixels at a rate of "1", "2", and "4", respectively, and the unit pixel of Blue is divided into two divided unit pixels at a rate of "1" and "2".

4. A display device according to claim 3, wherein the respective unit pixels have the same size in an extension direction of the scanning lines.

* * * * *